United States Patent [19]

McLain

[11] 4,218,877

[45] Aug. 26, 1980

[54] MACHINE FOR MAKING WOODEN CHAINS

[76] Inventor: Elmer L. McLain, Rte. 1, Box 468, Fort Gibson, Okla. 74434

[21] Appl. No.: 885,855

[22] Filed: Mar. 13, 1978

[51] Int. Cl.[2] ..... B27M 3/00

[52] U.S. Cl. ..... 59/10; 29/33.5; 29/564; 144/3 R; 144/41; 144/134 R; 144/326 R

[58] Field of Search ..... 90/11 C, 15 A; 29/33 R, 29/33 A, 563, 564; 144/1 R, 3 R, 41, 134 R, 137, 321, 322, 323, 326 R, 309 R, 309 A, 312; 59/1, 10, 35, 11

[56] References Cited

U.S. PATENT DOCUMENTS

| | | | |
|---|---|---|---|
| 523,432 | 7/1894 | Klatte | 59/10 |
| 647,044 | 4/1900 | Strathern | 59/10 |
| 1,606,313 | 11/1926 | Martenet | 144/134 R |
| 1,630,173 | 5/1927 | Dumont | 144/134 R |

FOREIGN PATENT DOCUMENTS

| | | | |
|---|---|---|---|
| 259232 | of 1928 | Italy | 144/41 |

*Primary Examiner*—W. Donald Bray
*Attorney, Agent, or Firm*—Head & Johnson

[57] ABSTRACT

Apparatus and method of machining a long wooden rod of square cross-section, of selected dimension, so as to provide a multi-link chain of separate inter-linked oval links. In its simplest form, the machine involves a single rotating cutter assembly, which includes two thin rectangular blades spaced apart, and contiguous with a central smaller radius portion, which has a concave contour. In the preferred arrangement four cutters are applied with the plane of each cutter coincident with a diagonal plane of the square rod and positioned over one corner, so as to provide a wooden cross with each arm rounded on its outer edge. By applying the cutters in such a way each of the links in one arm of the cross are cut to a selected length and rounded. By applying the cutters to each corner of the rod, a plurality of links lying in perpendicular planes are provided, which links are attached to each other at their ends. By inserting a small diameter high-speed milling cutter into the space between the two links and rotating the axis of the cutter in a plane perpendicular to the axis of the rod, the links are separated.

8 Claims, 13 Drawing Figures

MACHINE FOR MAKING WOODEN CHAINS

BACKGROUND OF THE INVENTION

1. Field of the Invention

This invention lies in the field of manufacture of decorative wooden link chains. More particularly, it applies to the manufacture of such linked wooden chain from a solid rod of wood, of square cross-section, of selected dimension.

2. Description of the Prior Art

While links of various shapes and sizes and such type of wooden chain have been carved by hand, others have been made out of links, which are machined separately and then cut, linked with each other, and reattached as by gluing, etc. have been well known in the art. However, no art has been shown which starting with a solid wood rod will produce a length of chain of a plurality of interlocked links, automatically and continuously.

SUMMARY OF THE INVENTION

It is a primary object of this invention to provide an apparatus and method for machining a solid wood rod of square cross-section, to provide a chain comprising a plurality of interlocked separate links.

It is a further object of this invention to provide an apparatus and method for manufacture of chains of separate links of wood by machining a square wood rod into a rod having the form of perpendicular arms each of which is rounded on the outer edge, and then cutting these arms inwardly at selected positions as to provide separate links, and then to separate the adjacent links by cutting with a small diameter milling cutter.

These and other objects are realized and the limitations of the prior art are overcome in this invention by providing an assembly, which in its most complex form comprises a framework having three separate sections; a precut section, a shaping section and a link dividing section. A length of wood, of square cross-section and selected dimension, is inserted through an opening in one end of the framework. Four cutters are provided, each of which comprises a rotating wide-bladed pair of cutters separated by the dimension of a center cutter of lesser radius and having a circular concave contour of the cutting edge.

The four cutters are arranged in pairs with their planes at 90° to each other, so as to shape the wooden square rod into the form of an X, by cutting away triangular shaped portions on the center of each of the faces of the square, and by rounding the outer edges of the arms of the cross, or X.

In a second step, the arms are further shaped by four cutters arranged again in pairs with their planes at 90°, to conform to the diagonal planes of the square rod. These cutters have thin rectangular blades on each side of a thicker smaller dimensional blade, again having a circular concave cutting edge. Each of these second cutter assemblies smooth the outer contour of the arms of the cross, and at selected positions of the rod, as it moves through the machine, the spacing between the second cutter assemblies and the axis of the rod is decreased. In this way, the cutters form each of the arms into separate links, which however are still attached to each other.

In this operation, all of the material inside of one link between the ends of two adjacent links is cut away so that the links are now formed, but are still attached to each other at the inside center of the radius of the ends of each link.

In a third section of the machine, the links are separated by inserting a small diameter milling cutter into the space where the links are attached, and by rotating the axis of this cutter in a plane perpendicular to the axis of the rod the two links are separated. This forms a chain of interlocked links, each of the links being of rounded contour and oval shape on the outside, and rectangular contour on the inside.

Means are described for on-line co-axial fastening of successive lengths of wood, at the inlet end of the machine, so that a continuous length of chain having the possibility of a great number of separate links is available.

BRIEF DESCRIPTION OF THE DRAWING

These and other objects and advantages of this invention and a better understanding of the principles and details of the invention will be evident from the following description taken in conjunction with the appended drawings, in which.

DESCRIPTION OF THE PREFERRED EMBODIMENT

Figure 1:
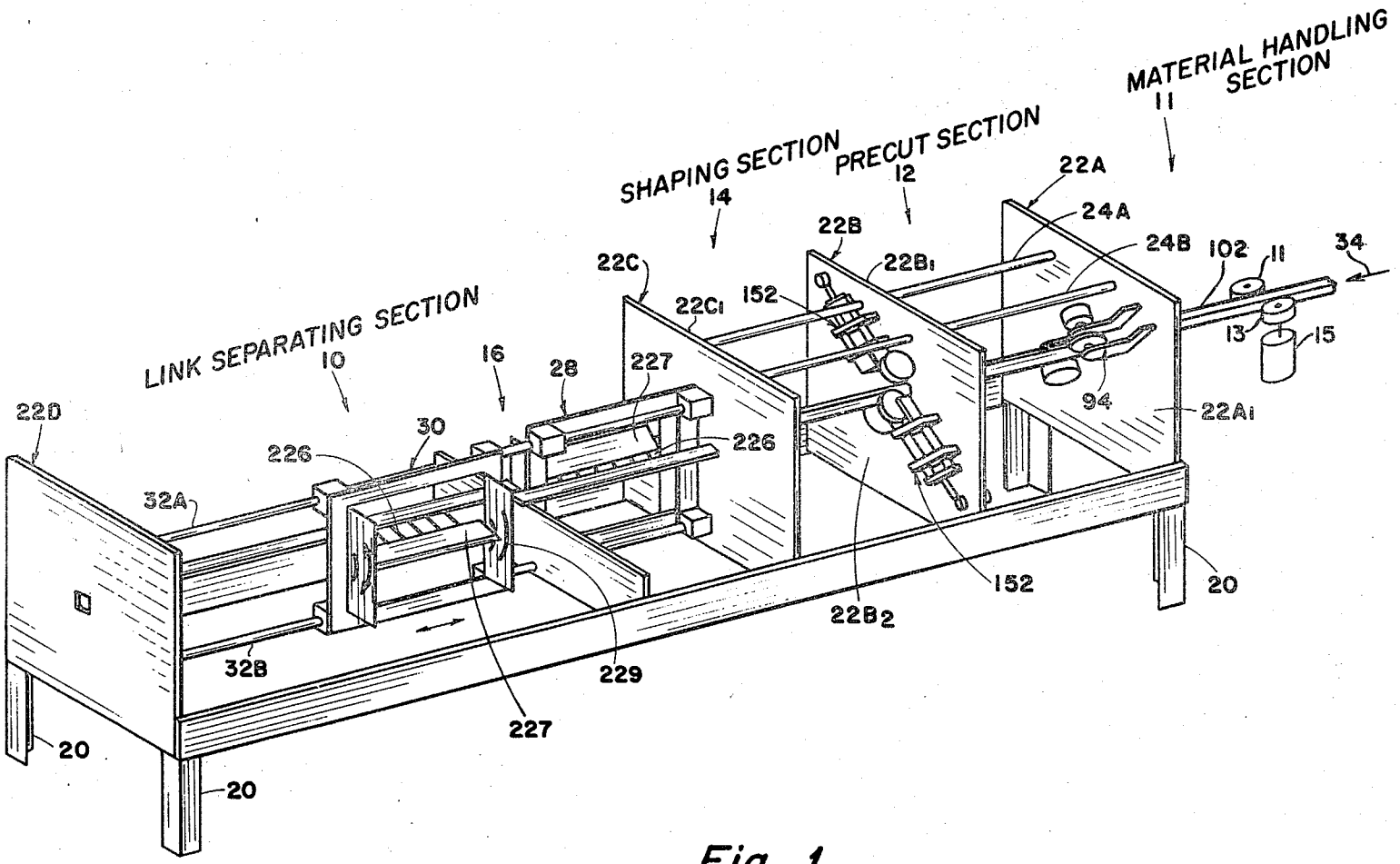
FIG. 1 represents in schematic fashion one embodiment of this invention.

Referring now to the drawings and in particular to FIG. 1 there is shown a schematic fashion the assembly of the machine.

Briefly the machine for making a wooden chain indicated generally by the numeral 10, comprises four separate sections;

1. a material handling section 11 which includes means for handling a plurality of lengths of square wood rods, and means for feeding these rods 102 successively along a colinear axis in accordance with arrow 34, through the cutting portions of the machine. Means are provided, though not illustrated, for joining butt ends of successive rod, as the rods are moving axially, so that a continuous length of chain will be provided at the outer end, which is greater in length than any single one of the separate rods. Means for relatively traversing the wood rod 102 past the cutting means 94 and 152, can be by any conventional known means, such as by pressure rollers 11, 13 and drive motor 15 shown schematically in FIG. 1.

2. a precut section 12, wherein the outer contour of the rod is prepared by cutting away excess material.

3. a shaping section 14 in which cutters shape the outer and inner contour of the arms of the cross into the form of interlocked links, providing two rows of links arranged in two perpendicular separate planes. In this section the shaping cutters separate the links except at their inside ends.

4. the link dividing section 16, wherein means are provided for separating the links by a small diameter high-speed milling cutter that cuts away the portions of the links near the axis of the original rod between the two link ends.

FIG. 1 will be further described in relation to other figures.

Figure 2:
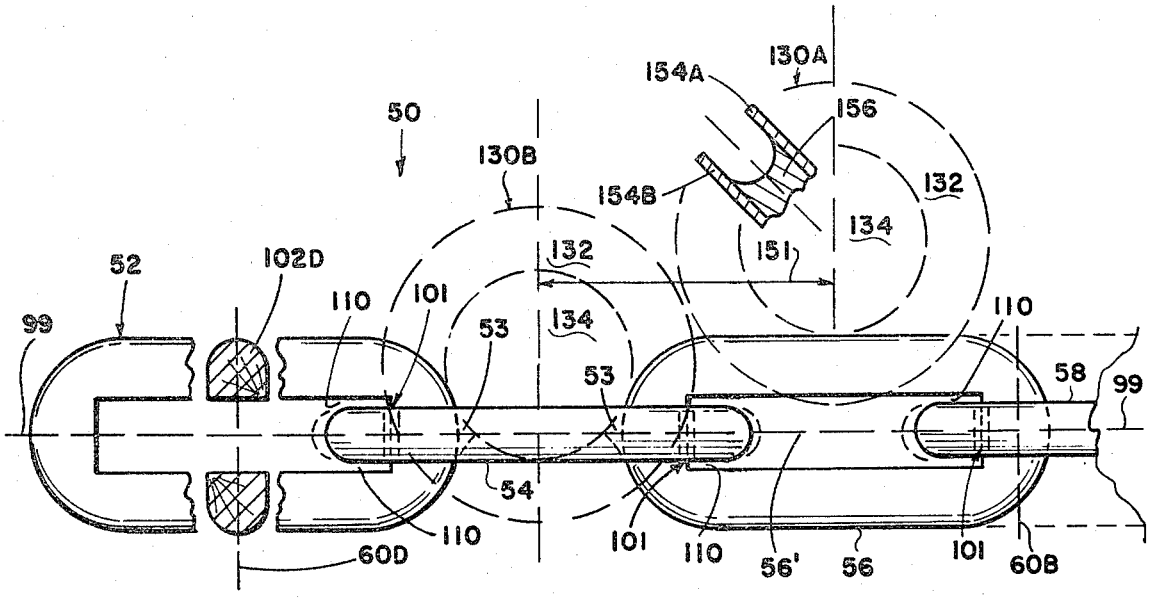
FIG. 2 represents the process of forming the links of the chain.

Referring briefly to FIG. 2, there is illustrated a finished portion of chain illustrated in general by the numeral 50. This comprises a sequence of links 52 and 56 arranged in one plane, and 54 and 58 arranged in a second plane at right angles to the first plane. Each of the links has a cross-section illustrated by the numeral 102D at the plane 60D and is of an oval shape as is customary for chains. The central opening in the links is rectangular, and in cross-section the inner surface of the link is square.

Figure 3:
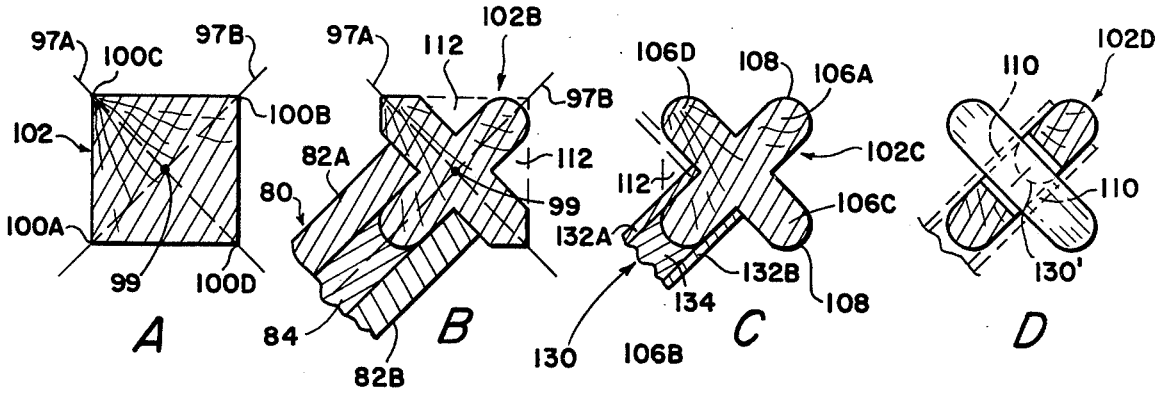
FIG. 3 represents successive cross-sections of the machined wood rod.

Referring now to FIG. 3, there are shown four figures; A, B, C and D. FIG. 3A illustrates the original cross-section of the square wooden rod 102, which has an axis 99 at the intersection of the diagonal planes 97B and 97A, between the corners 100A, 100B and the corners 100C and 100D respectively.

In FIG. 3B is shown the result of a first precut operation, in which the square rod 102B has been passed through a precut section, past a plurality of rotating cutters 80, which include two thick rectangular blades 82A and 82B of width W, separated by a dimension equal to the width of a central thicker cutter 84, which is of smaller radius and has a circular concave contour. When this cutter 80 is applied four times to the rod 102, with the central plane of the cutter coincident with one of the diagonal planes, such as 97B, of the rod, the four operations will produce a contour shown in FIG. 3C and identified by numeral 102C. The contour of the rod is now in the form of an X, or cross, in which each of the arms of the cross has a circular contour at its outer edge.

The purpose of precutting, with the cutters 80, either applied singly, or in the form of four separate cutters arranged with their planes at right angles, is to remove a triangular strip of wood 112 along the center of each of the four faces of the square rod. While it also shapes the outer edges of the rod, that is not of great importance since in the second operation in the shaping section, a concave cutter is again applied to shape the outer edges.

In the second operation, in the shaping section, there is a second cutter assembly 130, having thin rectangular blades 132A and 132B of width w, where w is a fraction of W, spaced apart and parallel to a central cutter 134, which has on its outer contour a circular concave contour. The purpose of this second cutting assembly is to move inwardly toward the axis of the rod, as a function of the linear movement of the rod, so as to cut the rounded countour of the ends of the links, and to cut out the material inside of, in the central portion of the links. This is illustrated in FIG. 2. Of course, another cutter would move inwardly from the opposite side of the axis to cut the rounded contour at the outer surface of the ends of the links of 52 and 56, while cutting out the central portion of the link 54, corresponding to the portion 56' of link 56.

In its simplest form, the apparatus might do away with the precut section and provide the use of the cutter 130 not only to shape the arms but to separate the ends of the links as will be further described.

In FIG. 3D is shown the rod with cuts 110 separating the links except for a small portion 101 (FIG. 2) at the axis of the rod tying together the two ends of adjacent links. This spacing is shown as numeral 110 in FIG. 2. The final separating operation at 101 will be illustrated in connection with FIGS. 11 and 12.

Having described the sequential cross sections and operations on the rod as illustrated in FIG. 3, the apparatus for carrying out these operations will be shown in more detail in the following figures.

Figure 4:
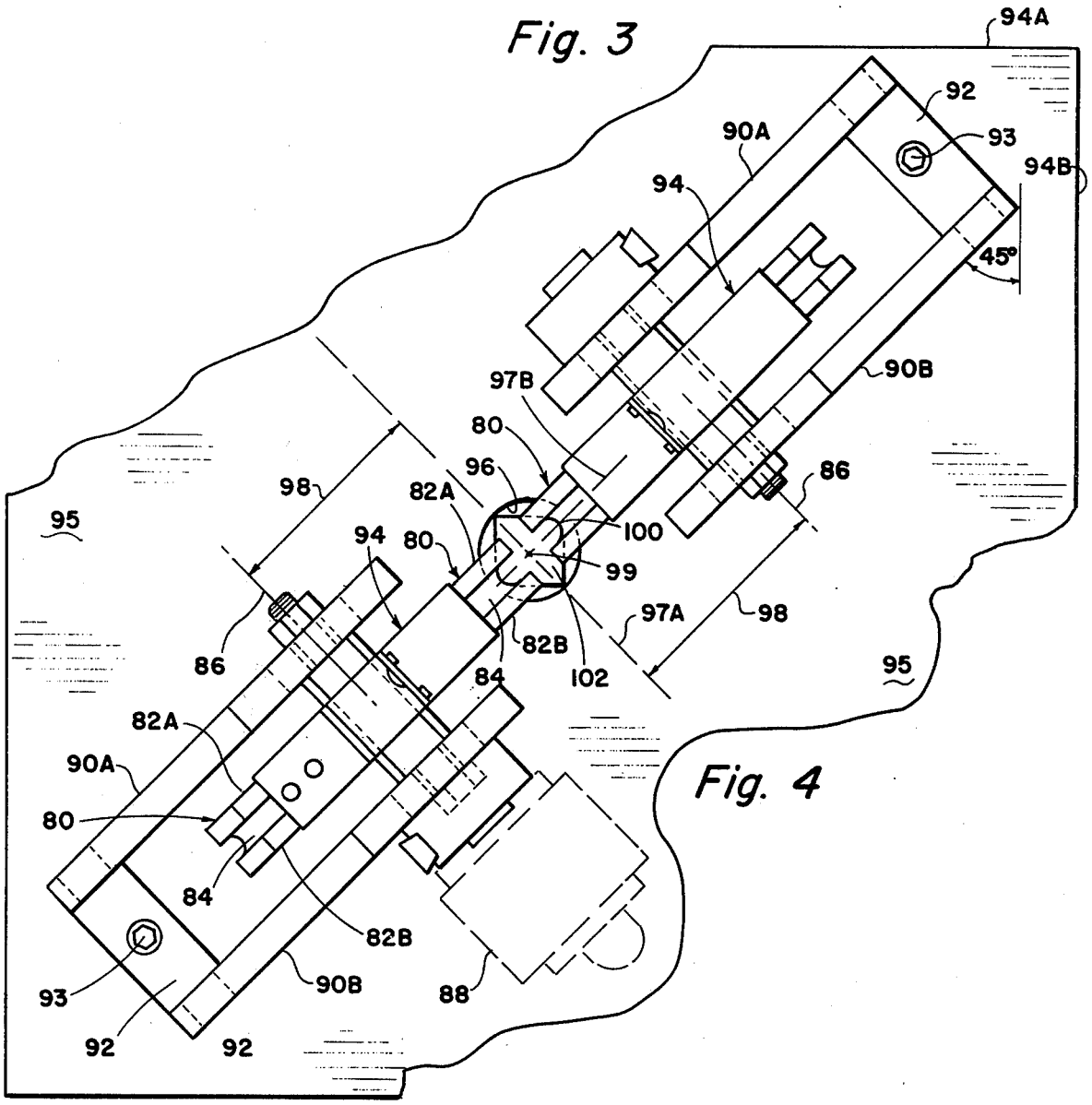
FIG. 4 illustrates the use of the first rotating cutter assemblies.

Referring now to FIG. 4, there is shown a pair of rotating cutter assemblies 80 mounted on the hubs 94. These hubs are supported on shafts which are journalled in spaced parallel plates 90A and 90B, which are attached to joining plates 92, to form C-shaped structures, which are attached to one of the upright walls 95 such as 22A1 of FIG. 1.

In the optimum assembly, there are two of these systems facing each other, with the planes of the two cutters 80 coplanar, and the axes 86 of the two cutters are spaced by a distance 98 from the axis 99 of the wood rod 102 of FIG. 4.

In FIG. 4 there is shown the vertical support wall 95 of plate 94A which corresponds to 22A of FIG. 1. Attached to this wall 95 with their planes at a 45° angle with the horizontal, are the two sets of cutters 80, which are spaced apart the selected distance 98 from the axis 99 of the rod. The planes of cutters are coincident with the diagonal plane 97B of the square rod, and they project in from the corners 100 of the rod a selected distance.

In the complete machine, there will be another set, identical to FIG. 4, but mounted on the inner surface 22B1 of a second plate such as 22B so that there will be four sets of cutters 80, each traversing a different corner of the square rod 102 as it passes through the circular opening 96, at the center of the assembly. Prior to passing through the plate 22A, the rod is guided by a square aperture with its surfaces horizontal and vertical, respectively, (not shown).

As indicated in FIGS. 3B, the first cutter assemblies 80 of FIG. 4 comprise two outer rectangular cutters 82A and 82B with an intermediate wider cutter of smaller radius, having a concave circular contour. These form the cross arms rounded on the outer edges such as 106 of FIG. 3C.

The rotating cutters and hubs, etc. are well known in the art, and no further detail is required. Nor is there detail required on the bearings and shafts and motor drives such as 88 which can be pneumatic, hydraulic, electric, etc. as is well known in the art.

While FIG. 4 shows two sets of cutters operating at opposite ends of a diagonal plane through the wood rod, there will be two additional cutter assemblies, the planes through the cutters at a 90° angle to the plane 97B of FIG. 4, and coincident with the plane 97A of the wood rod. Thus, with a single passage through the two sets of cutters, the rod will be shaped from that of FIG. 3A to that of FIG. 3C.

As indicated in FIG. 3C, a second set of cutters indicated by the numeral 130 is shown in position around one of the arms of the cross FIG. 3C. This cutter 130 has two thin rectangular blades 132A and 132B around an intermediate cutter of lesser radius and greater thickness, corresponding to that of the arms of the wood. This central cutter 134 can be similar to the cutter 84 of FIG. 4, for example. While the rectangular blades 132A and 132B are similar but much narrower, they correspond in width to the spacing 110 shown in FIG. 3D. The purpose of the second set of cutters is to separate the two crossed links shown in FIG. 3D by cutting the gaps 110 between the edge of one link and the inner surface of the next link.

Figure 7:
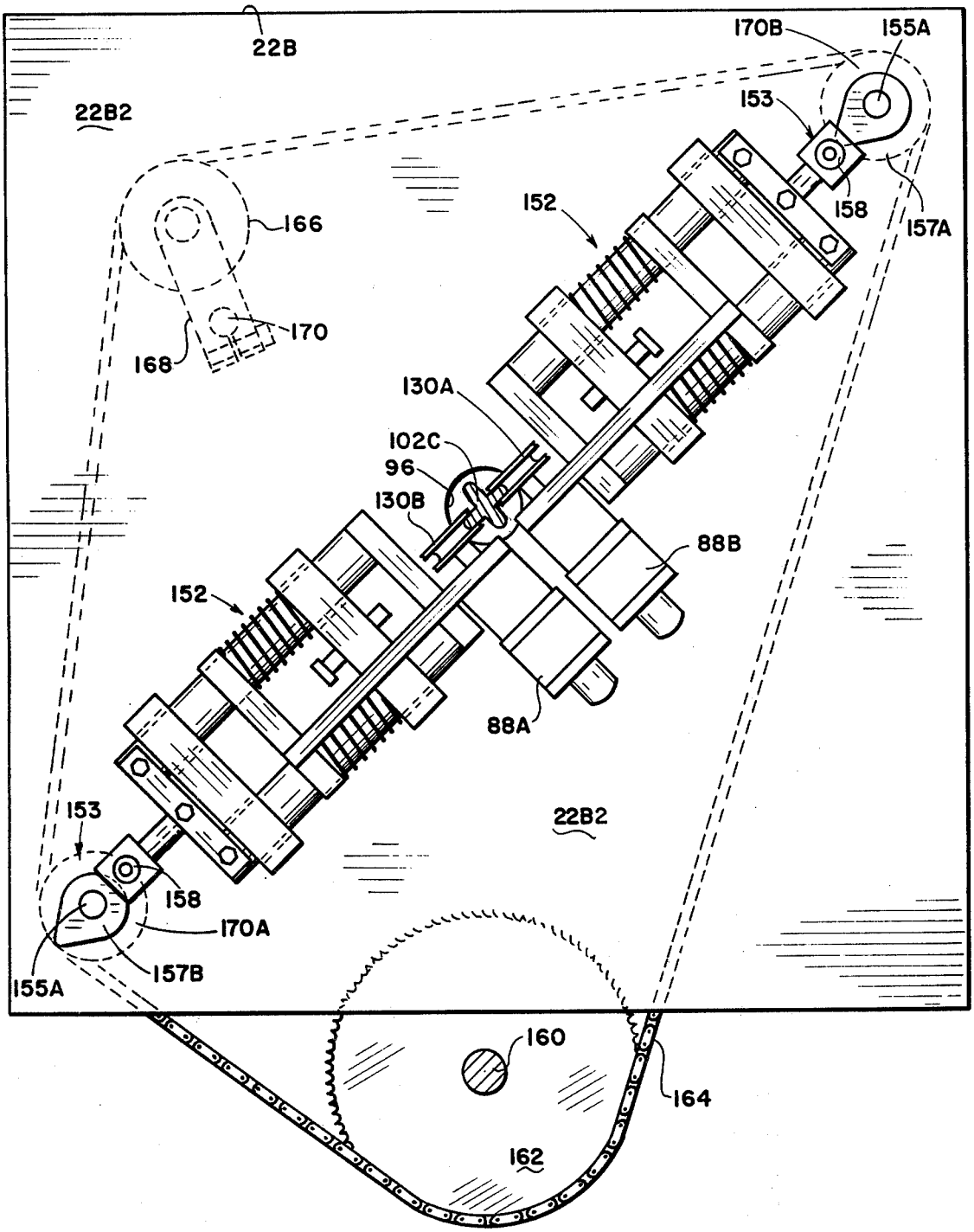
FIGS. 7,8,9 and 10 represent views of the second rotating cutter assemblies.

Referring now to FIG. 7, the cutters 130A and 130B are shown in dashed outline in FIG. 2. They are also shown in FIG. 7 mounted on two positioning devices 152 such that they can be moved closer or farther from the axis of the wooden rod 102.

Details of construction of the support apparatus 152 will be given later, which includes a cam mechanism 153 for moving the cutters 130A and 130B selectively closer to or farther from the axis 99 of the wood rod, as a function of the passage of the wood rod through the machine. For example, referring now to FIG. 2, consider that the cutter is moving and the wood is stationary. The cutter 130 in position 130A is farther from the axis of the wood rod than it is in its position 130B. In its position 130A, it is arrayed in accordance with the position in FIG. 3C. However, as the cutter moves to the left (or conversely, the wood rod moves to the right) the cutter moves inwardly toward the axis of the rod 99 as 130' in FIG. 3D. In so doing, the cam is designed so that the movement inwardly will produce a circular outer contour, corresponding to the end of the first link 56. At the same time, the center cutter has cut out material 56' inbetween the two sides of the link 54. Note that there will be a corresponding movement of a cutter like 130B moving in from the opposite side to cut away all of the rounded end of the links 56 and 52 except for a small tip 53.

As the cutter 130B moves outwardly again and to the left, it shapes the corresponding curved portion of the link 52 until it reaches the sides at a point corresponding to the position 130A, and so on.

It will be clear that while one cutter is moving against the upper edges of the links 56 and 52, another cutter displaced by a link will be moving on the opposite side of links 56 and 52, for example, to shape all of the links in the plane of the drawing. Correspondingly, there will be another pair of cutters like 130 operating on the links 58 and 54. The planes of those cutters will be at 90° to the plane of the cutters 130 and will produce a cross-section similar to that of FIG. 3D.

It will be seen that when the pass through the second set of cutters 130 is complete, the links will be completely cut and separated except for a small area of contact between the inner surfaces of two ends of two links, indicated generally by tne numeral 101.

In a third and final cutting step, the links are separated in this zone 101, and that apparatus will be described in connection with FIGS. 11 and 12.

Refer now to FIGS. 7, 8, 9 and 10 which show mechanisms for supporting, and moving the cutters 130 with respect to the wood rod as a function of the longitudinal axial movement of the rod. In FIG. 7 is shown a support wall 22B2 which can be a surface of the plate 22B of FIG. 1, for example. There is a longitudinal shaft 160 carrying a chain sprocket 162 that carries a chain 164 around a pair of sprockets 170A and 170B over a pulley 166 which is mounted on arm 168, which is fastened at a selected angle around a post 170. The purpose of the pulley, or sprocket 166, is to adjust the tension in the chain 164.

Figure 10:
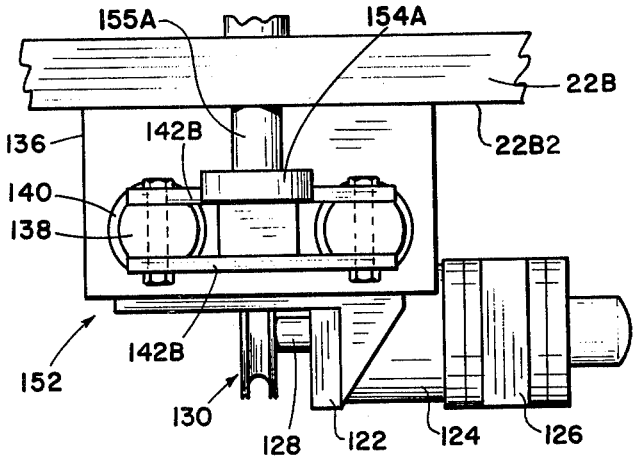
Figure 8:
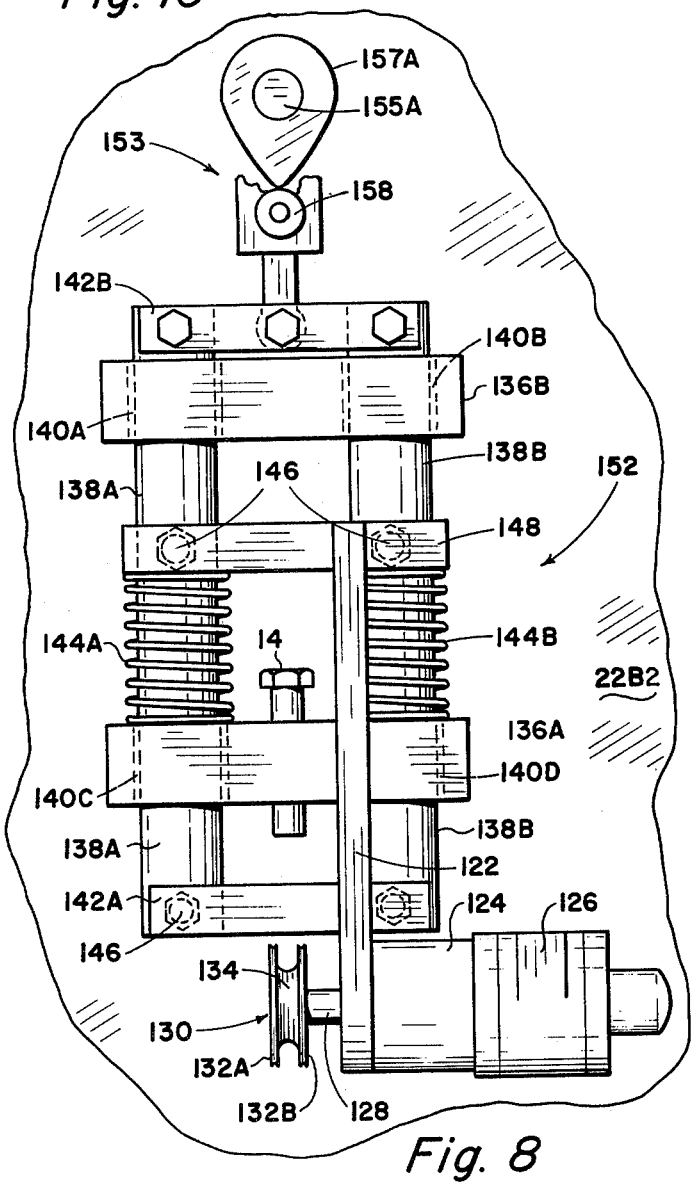
Figure 9:
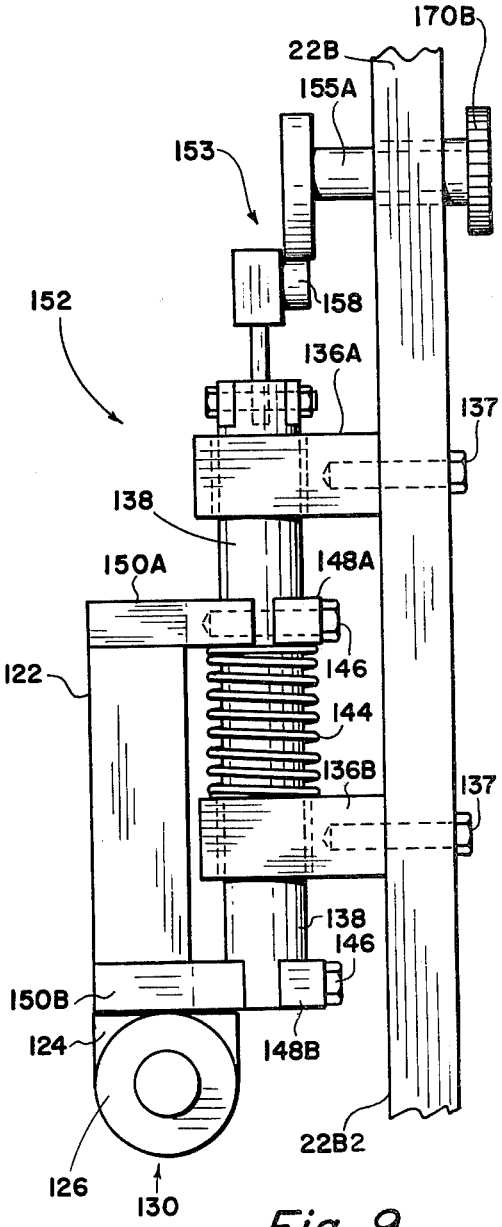

On the plate 22B there are two mechanisms 152 for supporting and translating radially inwardly and outwardly the two sets of cutters 130A and 130B, separately mounted on opposite sides of the wood rod 102C, and driven by motors 88A and 88B, for example. The mechanism 152 for supporting and positioning the cutters 130 is shown in FIGS. 8, 9 and 10, for example. Only one of the mechanisms will be described in detail, and the other will be identical in a mirror image sense.

There are two support plates 136A and 136B, which are mounted to the face 22B2 of the plate 22B by means of bolts 137, or other means. These have colinearly bored openings and bushings 140A and 140B. There are two of these openings in each of the blocks 136A and 136B. Two cylindrical rods 138A and 138B are adapted for longitudinal motion through the bushings 140 in the blocks 136, which are supported on the plate 22B.

The two rods are tied together by means of plates 142A and 142B, at opposite ends, so that they will move together as a rigid rectangular structure. The rods 138 are clamped by means of plates 150A and 150B, with clamps 148A and 148B, which are held together with bolts 146. This supports a structure 122 which supports a block 124 which supports a motor 126. The motor shaft 128 carries a cutter assembly 130, which comprises the two narrow rectangular blades 132A and 132B with a central cutter of less radius and circular contour 134.

These cutters 130 are identical to those shown in FIG. 3 and FIG. 7. A stop screw 14 may be provided to limit the outward movement of the rods supporting the rotating cutter assembly. The sprockets 170A, 170B are driven synchronously by the chain 164, and are supported in shafts 155 journalled in the plate 22B. On these shafts are corresponding cams 157, which cooperate with rollers 158, and which are shaped so as to force the cutter supporting means 122, and the cutter assemblies 130 downwardly in accordance with the cam surface. As the cam rotates, the springs 144 maintain contact between the moving assembly and the cam so that adequate control of the cutters is maintained at all times.

The axial movement of the wood rod is controlled by the shaft 160, such as by means of a lead screw or similar means, (not shown, but well known) and thus the chain drive of the cams is synchronous with the axial movement of the wood. By correctly positioning the cams, it is possible to provide the precise movement inwardly of the cutter assemblies 130 by means of the cams, as the wood rod is moved axially in accordance with the rotation of the shaft 160.

The precise design of the mechanism of FIGS. 7, 8, 9 and 10 is not critical. Other ways and different designs, dimensions and configurations can be provided for providing simultaneous control of the axial movement of the rod and the radially inwardly and outwardly movement of the rotating cutter assemblies 130, to accomplish the cutting to shape of the links shown in FIG. 2. Therefore, no further detail of the movement, except to say that it is cam controlled, is necessary to provide the type of motion required for cutting the links.

As in the case of the precut section in which the two sets of cutters are mounted on the inner walls of two spaced apart bulkheads, the shaping section will comprise two sets of opposed cutters, one set mounted on each of the inner surface of the two bulkheads, such as 22B2 and 22C1, with the planes of the two sets of cutters at right angles, so that there will be simultaneous shaping of all four legs of the cross shown in FIG. 3.

It must be remembered, however, that the opposed cutters 130A, 130B of FIG. 7 are not in the same plane parallel to the plate 22B. Their planes (parallel to plate 22B) are spaced apart by twice the distance 151 between the centers of the cutters 130A and 130B of FIG. 2, measured along the axis of the wood rod.

Figure 5:
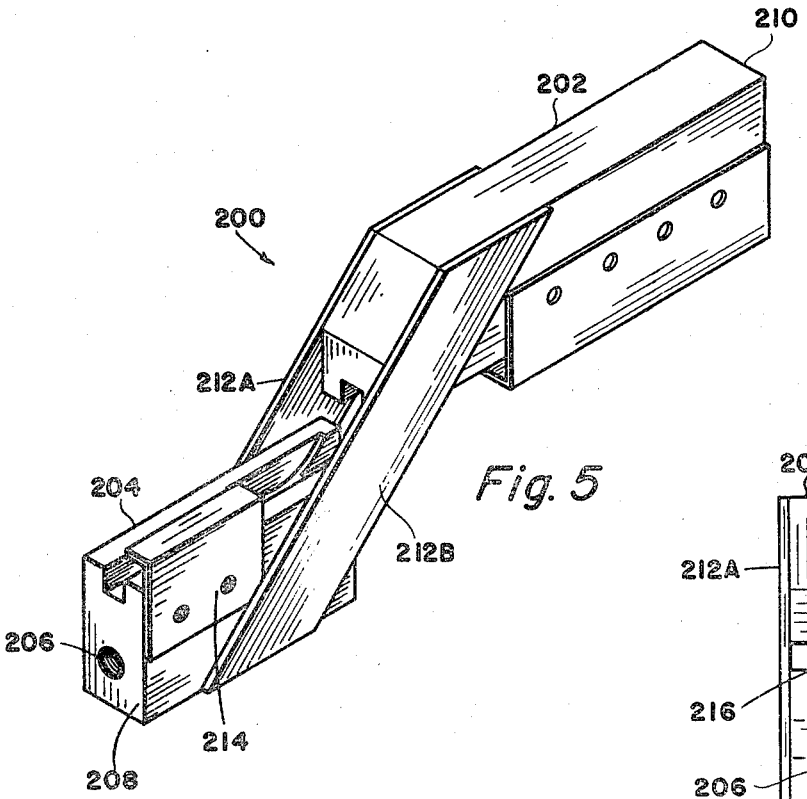
FIGS. 5 and 6 represent a support means for the partially machined rod.
Figure 6:
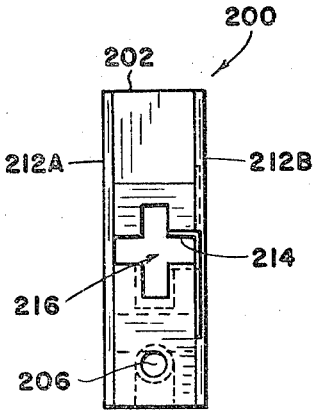

In FIGS. 5 and 6 is shown one possible type of support means for the shaped rod shown in FIG. 3C as it passes from one set of cutter mechanisms 152 to the second set of cutter mechanisms. The structure of FIG. 5 comprises two parts 202 and 204, which are displaced longitudinally from each other and held in position by plate 212A and 212B. In FIG. 6 it is shown that there are grooves on the inner faces of these two parts 202 and 204 so that a cross-section 216 is provided which provides guidance for the rod after it completes the passage through the four cutters as in FIG. 3C.

There may not be any need for the support, although it is desirable to provide some support against the pressure of the cutter as it moves inwardly against the wood rod. Various other constructions are possible, in which each of the portions 202 and 204 may have a complete enclosure such as the opening 216, so that wherever there is cutter pressure there will be guidance for the wood rod.

Figure 11:
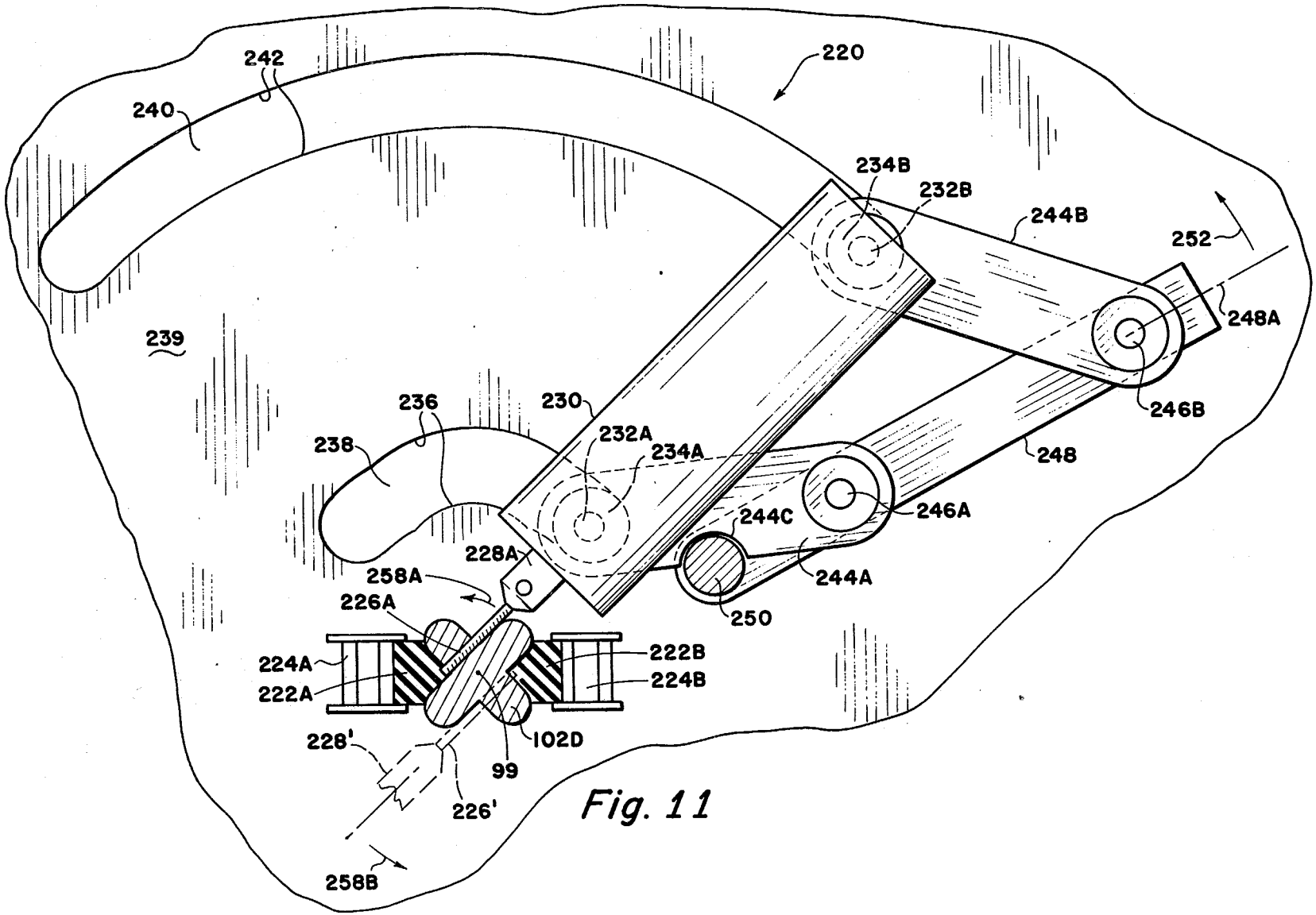
FIGS. 11 and 12 illustrate the operation of separating the separate links of the chain.
Figure 12:
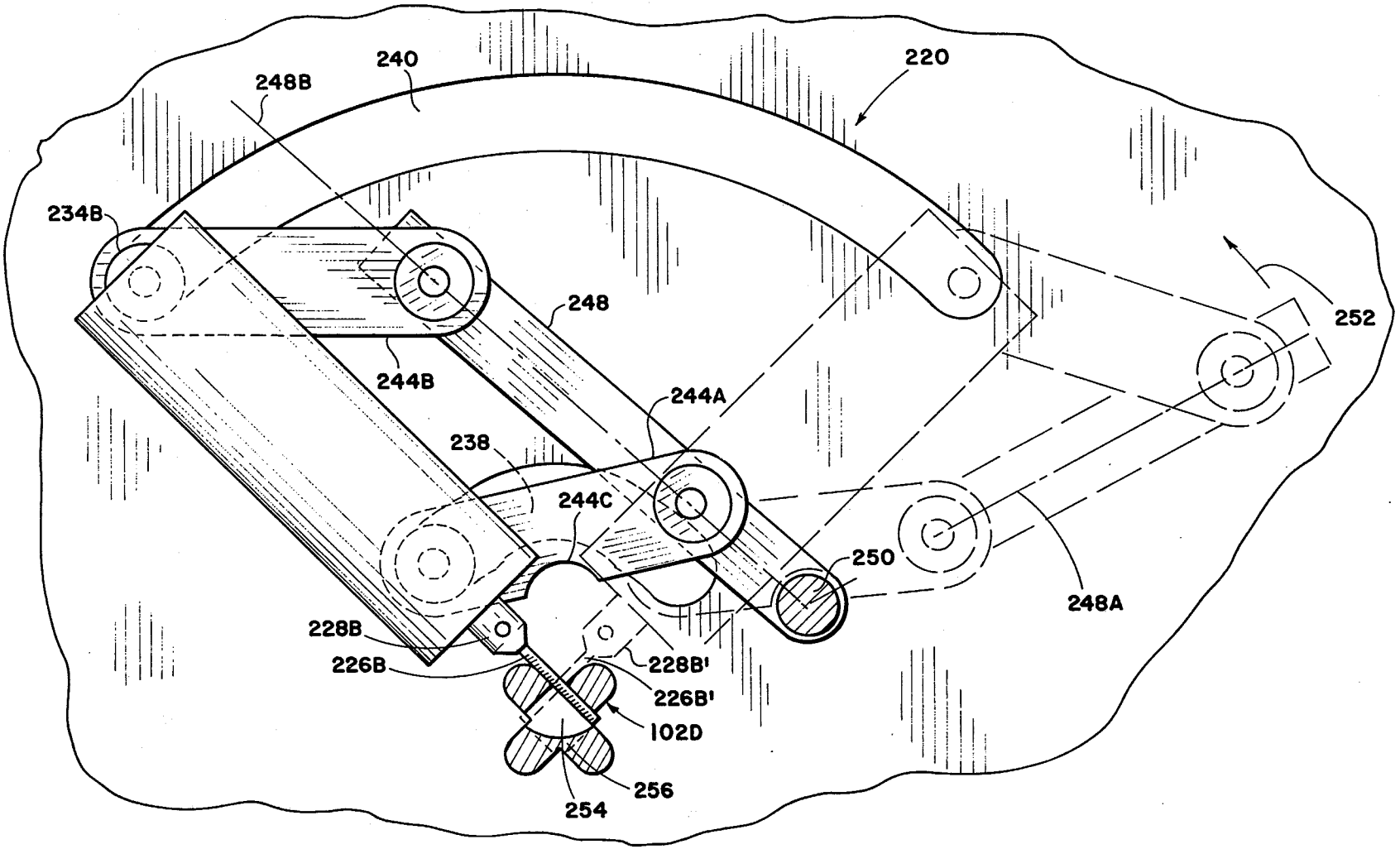

Referring now to FIGS. 11 and 12 and momentarily back to FIG. 2, after passing the second set of cutters 130, the shape of the links of the chain will be as shown. in FIG. 2 and FIG. 3D.

The next step is to cut into the zone 101 at which the ends of each adjacent pair of links is now jointed. The apparatus of FIGS. 11 and 12 is designed to provide this cutting. FIG. 11 shows the pairs of links in the form of arms of a cross, and there are shown a means for supporting the machined wooden rod, since the links are separated, all except a very small portion of the contact. This mechanical support is given by two belts which press in from the sides to support the links of the chain as it moves axially. Fixed guides may also be mounted to support the links on the side opposite the side being machined. The cross-sections of the belt are shown as 222A and 222B. This can be flexible, compressible, rubber-like resilient material which is in complete loops which pass around rollers such as 224A and 224B, for example, in a well-known manner. The cutters 226 that are going to operate to cut these links apart are mounted in frames 28 and 30, and they travel longitudinal on rails 32A, 32B at the identical speed as the wooden rod controlled by the rotating shaft 160. Since the linear movement of the racks 28 is synchronized with the linear movement of the wooden rod, it can be considered that there is no relative motion between the cross shown in FIG. 11 and the mechanism surrounding it. Consequently, the process of cutting is as though the rod 102D, the belt 222 and the rollers 224 are stationary, and the mechanism surrounding it is also stationary.

There is a small diameter cylindrical milling cutter 226A which is supported in a chuck 228A, which is supported on a motor shaft (not shown), so that it can be rotated at a selected speed. The diameter of the cutter 226 is substantially the same as the spacing 110, which has been cut between the links as shown in FIG. 2.

The cutter 226A can then be inserted in the space 110 in the zone shown by the dashed lines 101 of FIG. 2. The motor is not shown but is mounted on the plate 230. The plate 230 has two sets of rollers 234A and 234B, which are supported on pins 232A and 232B. The rollers are guided in semi-circular cuts or grooves 238 and 240 in a plate 239. The cut 240 is of greater radius about a selected axis. The mechanism indicated generally by the numeral 220 is designed to rotate this milling cutter from the position 226A shown in FIG. 11 to the position 226B shown in FIG. 12 moving in the direction of the arrow 258A of FIG. 11. In FIG. 12 the original position is shown as 226B' and the final position is 226B, and the area 254 has been cut out by the cutter 226B.

In FIG. 11 there is shown in dashed lines a second cutter 226' mounted in a chuck 228' driven by a second motor and so on which moves in the direction 258B, so that a second cut can be made by the cutter 226' which will remove the small portion of wood left in the volume 256 of FIG. 12. Thus by using two cutters in successive operations, the wood joining the two ends of adjacent links on their inside surfaces can be cut away, thus freeing the two links.

Thus, by rotation of the cutter 226 within a plane perpendicular to the axis of the wood rod, the cutter would remove the area 254 of FIG. 12. It would be possible also by cam action, or otherwise, as would be well known in the art, of moving the cutter 226 farther in and then out again, so that the area 256 could be cut out at the same time that the area 254 is cut out. Thus, a single rotating cutter with a rotation of its axis in a plane perpendicular to the rod and a further movement radially inwardly and outwardly of the rod, could cut out all of the joining material within the part 101 joining the two links.

The rest of the mechanism 220 comprises the circular tracks 242 in the groove 240, and the tracks 236 in the groove 238, with corresponding rollers on the plate 230, which supports the motor and cutter, plus an operating lever 248, which rotates about a selected axis 250, and controls the movement of the plate 230 by means of two links 244A and 244B, which are pivoted to the operating arm 248 by pins 246A and 246B respectively. Thus, rotating the arm 248 from position 248A in a direction of the arrow 252 to its final position 248B in FIG. 12, will provide the requisite 90° rotation of the cutter 226, and removal of the material shown in FIG. 12.

The apparatus shown in FIGS. 11 and 12 is shown by way of example only, and is not a requirement since other mechanisms can be made to control the movement of the milling cutter 226. Furthermore, the rod can be held stationary while the cutter is rotated or conversely, the cutter can be moved axially of the rod as the rod moves so that there is no relative movement while the cut 254 is made.

Having separated the links in the zone 101 by the mechanism of FIGS. 11 and 12, or equivalent the links are now separated, and the chain is complete.

In review, what has been described is a method and apparatus, whereby a rod of wood of selected square cross-section can be machined in three separate operations, by a selected group of cutters to first form a cross-section of an X, or a cross, with four arms, and then cutting into the arms at selected points to form links, and then cutting into the links at a selected point to separate adjacent links.

The method of operation can vary considerably. As explained in the description, four sets of pre-cut cutters can be used to provide a cross form to start with, then the shaping cutters can be used to provide the links out of the cross form, and then the separation cutter is used to separate the links.

It will be clear that a chain can be produced with a single precut cutter, which is utilized four times as the wood rod is passed through the machine four different times after being rotated 90° during each pass.

It will be clear also that the shaping section can be done with a single cutter, where the wood rod is passed through the cutter four times, being rotated 90° each time, being such that the movement of the rod and the radial movement of the shaping cutter are properly synchronized since opposed cutting operations have to be done at different points for the successive alternating links. Lastly, a single milling cutter, as shown in FIGS. 11 and 12, can be used to separate the links.

Going even farther, it is possible to simplify the process of making a chain by eliminating entirely the precut section and starting with the shaping section. The only difference in using the shaping cutter with and without the precut section is that without the precut section there is a longitudinal triangular rod of wood which is not cut away but remains as a slender stick which may cause some difficulty in passage through the machine. Thus, the precut section is desirable and is used primarily, so that all wood removed is removed in the form of chips and not in the form of slender rods. Except for this feature of the slender rods 112 of triangular cross-section, which are taken out of each of the four surfaces of the rod in the precut section, the chain can be formed only by the use of the shaping cutters, and of a single shaping cutter. Thus, in its simplest form the process of cutting a square wooden rod into the form of separate links of a linked chain involves a single shaping cutter which is controlled to move radially inwardly as a direct function of the translation, or axial movement of the rod and four such passes are used, and then a final cut separating each of the links.

As a matter of production, depending on various factors of quantity and cost, and so forth, it may be desirable to build such a machine with four cutters in the precut section and four cutters in the shaping section, and two sets of cutters or more in the separating section. This is a matter of judgment, but the process as described in the claims can utilize solely the simple single shaping cutter and a single separating cutter.

Figure 13:
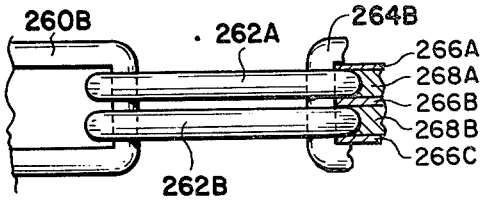
FIG. 13 illustrates an optional form of double linked chain that can be made with the described process.

It will be clear also that by the use of selected cutter assemblies, the links of the chain can be of other selected cross-sections. Also, by suitable choice of cutters, the single links can be machined as two side-by-side, narrower links for example. This is shown in FIG. 13 where a cutter assembly is shown comprising three rectangular cutters 266A, 266B and 266C separated by two wider concave cutters 268A, 268B. These links would be separated in the same way illustrated in FIGS. 11 and 12.

While the invention has been described with a certain degree of particularity, it is manifest that many changes may be made in the details of construction and the arrangement of components. It is understood that the invention is not to be limited to the specific embodiments set forth herein for purposes of exemplification, but is to be limited only by the scope of the attached claim or claims, including the full range of equivalency to which each element thereof is entitled.

What is claimed is:

1. Apparatus for machining a wooden rod, of square cross-section, of selected length and transverse dimension, to provide a multi-link chain of separate interlinked links, comprising;

A. at least a first rotating cutter assembly means comprising (1) two spaced-apart first rectangular rotating cutters of selected width W, and means for fixedly positioning said first cutters in a selected position on a first diagonal plane through said square rod, said rectangular cutters spaced equally on opposite sides of said diagonal plane a selected distance, (2) a second rotating cutter of selected width comparable to W, having a concave circular cutting edge positioned with its central plane of rotation in said diagonal plane, with said cutting edges at a selected fixed distance from the axis of said rod, and (3) means to rotate said first rotating cutter assembly;

B. at least a second rotating cutter assembly means comprising (1) two spaced-apart third rectangular rotating cutters of selected width w, where w is a fraction of W, of selected radius, (2) a fourth rotating cutter of selected width, having a concave circular cutting edge positioned with its central plane of rotation in said diagonal plane, with said cutting edges of selected radius, and (3) means to rotate said second rotating cutter assembly;

C. means for relatively axially moving said wooden rod, and said first and second rotating cutter assembly means;

D. means for selectively moving said second rotating cutter assembly means closer or farther from the axis of said wooden rod, as a function of its position along said rod;

whereby said links will be formed, but attached sequentially to each other; and

E. means for separating adjacent links.

2. The apparatus as in claim 1 including at least one additional first cutter assembly means, identical to the first pair comprising said first and second cutter assembly means, and correspondingly positioned with respect to the axis of said square rod about the diagonal planes passing through each of the other three corners of said rod.

3. Apparatus for machining a long wooden rod of square cross-section of selected dimension and selected length, so as to provide a multi-link chain of separate interlocked links comprising:

A. at least one rotating cutter assembly means comprising (1) a first rotating cutter comprising two spaced apart parallel thin rectangular rotating cutter blades of selected radius and spacing, (2) a second rotating cutter comprising a concave circular cutter blade of selected width, radius of curvature, and radius, and (3) means to position said first and second rotating cutters coaxial and with their planes parallel, with said two thin blades symmetrically positioned on opposite sides of and contiguous with the sides of said second cutter, B. means to relatively axially move said first rotating cutter assembly and said wooden rod, with said central plane of said first cutter assembly means coincident with one of the diagonal planes of said wooden rod;

C. means to vary the spacing of the axis of rotation of said first rotating cutter assembly with respect to the axis of said wooden rod, as a function of said relative motion;

whereby said links will be formed, but attached sequentially to each other;

D. at least one small diameter milling cutter; and

E. means to insert said small diameter milling cutter into the space between two links where said two links are joined, and means to rotate the axis of said milling cutter in a plane perpendicular to the axis of said rod, to free one link from its interlocking links.

4. The apparatus as in claim 3 in which said first and second rotating cutters are on the same rotating hub.

5. The method of using an apparatus for machining a long wooden rod of square cross-section of selected dimension and selected length, so as to provide a multi-link chain of separate interlocked links, said apparatus comprising:

A. at least one rotating cutter assembly means comprising (1) a first rotating cutter comprising two spaced apart parallel thin rectangular rotating cutter blades of selected radius and spacing, (2) a second rotating cutter comprising a concave circular cutter blade of selected width, radius of curvature, and radius, and (3) means to position said first and second rotating cutters coaxial and with their planes parallel, with said two thin blades symmetrically positioned on opposite sides of and contiguous with the sides of said second cutter;

B. means to relatively move said first rotating cutter assembly and said wooden rod, with said central plane of said first cutter assembly means coincident with one of the diagonal planes of said wooden rod;

C. means to vary the spacing of the axis of rotation of said first rotating cutter assembly with respect to the axis of said wooden rod, as a function of said relative motion;

D. at least one small diameter milling cutter;

E. means to insert said small diameter milling cutter into the space between two links where said two links are joined and means to rotate the axis of said milling cutter in a plane perpendicular to the axis of said rod, to free one link from its inerlocking links;

the method of using said apparatus to produce said chain comprising:

F. positioning said at least one rotating cutter assembly with the plane of said cutter coincident with the diagonal plane passing through a first corner of said rod;

G. relatively moving axially said cutter assembly and said rod along said first corner; while H. varying the spacing between said cutter assembly and said rod, as a first selected function of said relative movement;

I. repositioning said rotating cutter assembly means in the proper geometric relation with respect to a second corner of said rod, 180° from said first corner;

J. relatively moving axially said cutter assembly and said rod along said second corner; while K. varying the spacing between said cutter assembly and said rod as said first selected function of said relative movement;

L. repeating steps I, J, K, with respect to respectively the third and fourth corners of said rod, +90° and −90° from said first corner, and as a second selected function of said relative movement; and M. inserting said at least one milling cutter into the space between two links, where said two links are joined; rotating said milling cutter about its axis, and rotating the axis of said milling cutter in a plane perpendicular to the axis of said rod, to free at least one link from at least one interlocking link.

6. The method as in claim 5 including at least an additional identical rotating cutter assembly positioned around the axis of said rod, at 180°, from said first cutter assembly means; and relatively passing said wooden rod twice, past said at least two cutter assemblies, whereby at least two corners of said wooden rod are machined simultaneously.

7. The method as in claim 6 including an additional plurality of identical small diameter milling cutters each in the same plane, parallel to each other, and spaced apart by a dimension equal to the length of the links of the chain; and simultaneously inserting said plurality of milling cutters into the spaces between said links, where said links are joined together, and rotating simultaneously the axis of said milling cutters in planes perpendicular to the axis of said rod, to simultaneously free a plurality of links from each other.

8. The method as in claim 7 including the step of holding the plurality of links by resilient means while the steps of claim 7 are being carried out.

* * * * *